United States Patent [19]

Passarini et al.

[11] Patent Number: 4,776,859

[45] Date of Patent: Oct. 11, 1988

[54] PROCESS FOR BENEFICIATING COAL BY MEANS OF SELECTIVE AGGLOMERATION

[75] Inventors: Nello Passarini, Colturano; Antonio Vettor, San Donato Milanese, both of Italy

[73] Assignee: Eniricerche S.p.A., Milan, Italy

[21] Appl. No.: 117,630

[22] Filed: Nov. 5, 1987

[30] Foreign Application Priority Data

Nov. 11, 1986 [IT] Italy ..... 22286 A/86

[51] Int. Cl.[4] ..... C10L 5/14; C10L 5/16

[52] U.S. Cl. ..... 44/15 R; 44/15 A; 44/23; 44/24

[58] Field of Search ..... 44/15 A, 23, 24, 15 R

[56] References Cited

U.S. PATENT DOCUMENTS

| | | | |
|---|---|---|---|
| 4,360,422 | 11/1982 | Oka et al. | 44/24 |
| 4,412,839 | 11/1983 | Taylor | 44/34 |
| 4,498,905 | 2/1985 | Skinner | 44/24 |
| 4,726,810 | 2/1988 | Ignasiak | 44/24 |

FOREIGN PATENT DOCUMENTS

| | | | |
|---|---|---|---|
| 2066285 | 7/1981 | United Kingdom | 44/15 A |

*Primary Examiner*—Wayland Stallard

*Attorney, Agent, or Firm*—Hedman, Gibson, Costigan & Hoare

[57] ABSTRACT

A process is disclosed for the beneficiation of coal by means of selective agglomeration, wherein an agglomerating blend is used, which is constituted by:

one or more main agglomerating agent(s), selected from the light hydrocarbons having a boiling temperature not higher than 70° C., one or more non-ionic additive(s), selected from oil-soluble ethoxylated compounds;

one or more heavy co-agglomerating agent(s) selected from oils deriving from the distillation of coal-tar, having a boiling temperature comprised within the range of from 200° to 400° C. or the residual products from oil processing or blends thereof.

12 Claims, No Drawings

PROCESS FOR BENEFICIATING COAL BY MEANS OF SELECTIVE AGGLOMERATION

The present invention relates to a process for the beneficiation of coal by means of selective agglomeration.

The more widely known processes for the beneficiation of coal are mainly based on the difference existing in physical characteristics between the prevailingly organic material, and the prevailingly inorganic material.

For example, such materials can be separated either on the basis of their size, or on the basis of their density, or on the basis of their different electrical or magnetic behaviour.

When the physical characteristics of the materaisl to be separated are similar, said processes are not always advantageously applicable. A solution of this problem consists in taking advantage of another characteristic of the phases to be separated: their different affinity for water, typically used in the agglomeration treatments, and in foam-flotation treatments.

In particular, the agglomeration consists in forming a water-coal dispersion, to which an organic compound of hydrocarbon nature is added with stirring, for the purpose of producing agglomerates prevailingly formed by pure coal and an aqueous dispersion containing solids of prevailingly inorganic nature. As the agglomerating organic compounds, the fuel oils of petroleum origin, the heavy oils deriving from the distillation of tar from coal pyrolysis (coal-tar), the middle petroleum distillates (kerosene, gas oil, and so forth) are used.

A drawback affecting this method is constituted by the fact that the oil used to agglomerate coal is usually left inside the product, with the consequence that the process costs are considerably increased.

On the other hand, the possible recovery of the agglomerating agent would involve an equivalent, if not larger, increase in costs, due to the low volatility of the above cited products.

A remedy to such drawbacks is represented by the use, as the agglomerating agents, of volatile hydrocarbon solvents, and their derivatives, which can be recovered, after that the inorganic matter has been removed. As the light hydrocarbon solvents, above all, n-pentane, n-hexane, petroleum ethers, and their fluorochloroderivatives (Freons) are used. Said solvents involve, in general, a higher selectivity than shown by the heavy solvents, but, relatively to these latter, they suffer from the drawback of having lower bridging capabilities, so that some coals, having more unfavourable surface characteristics, can be agglomerated with the heavier oils, and not with the light ones.

In Patent Application No. JP 84/105089 to Kokay published before examination, an agglomerating process has been recently claimed, which uses, together with an agglomerating agent (selected from paraffin oil, light oil (gasoline), crude oil, asphalt, oil from coal liquefaction, low-temperature tar, high-temperature tar, all of the types of residual oil, and fuel oil (the preferred solvent)); a non-ionic, oil-soluble compound—in particular, ethoxylated nonyl-phenol—as an additive, in highest amounts of 5% by weight relatively to the agglomerating agent.

According to the Authors of said Patent Application, the therein claimed process shows higher agglomeration speeds, lower consumptions of agglomerating agent, a larger de-hydration (a smaller amount of water in the agglomerate), and makes it possible to obtain smaller ash amounts in the product.

Therefore, such a process represents an improvement as compared to the use of the cited individual products, but is unsuitable for an economically favourable end recovery of the agglomerating agent, due to the not high volatility of the claimed liquids.

Furthermore, according to that route, the possibility of treating partially oxidated coals, which cannot be agglomerated by other processes, is not mentioned.

This latter aspect was faced by other researchers (e.g., D. V. Keller, U.S. Pat. No. 4,484,928), who claimed the use, together with either light or heavy agglomerating agents, of various additives, such as the carboxy acids (in particular, oleic acid and its salts), amines, alcohols and their derivatives, etc., in the agglomeration of partially oxidated coals. In the same patent, Keller also discloses the use of an ethoxylated phenol (whose composition is not supplied), as a way to considerably shorten the times of agglomeration of a coal which is already endowed, per se, with agglomerative characteristics.

Both the use of either acidic or basic compounds, and the use of ethoxylated phenols does not anyway make it possible to agglomerate particularly difficult-to-agglomerate coals, because of the poor bridging capabilities of the agglomerating liquids used (Freon, n-pentane, n-hexane, petroleum ethers), as the hereunder Examples demonstrate.

In the instant case, the present Applicant surprisingly found that, by using an agglomerating blend constitued by compound which, when they are used alone, are per se known, it is possible to agglomerate coals which cannot be agglomerated, or are poorly agglomerative, even if light solvents are used.

Very good results are simultaneously achieved in terms of selectivity and recovery.

In fact, such coal types, as a highly-volatile Russian bituminous coal, and, still more, an Italian subbituminous coal (Sulcis), which, due to their poor surface hydrophobic characteristics, do not agglomerate with pentane, either alone, or to which as an additive ethoxylated phenol has been added, can be agglomerated by means of the blend used by the present Applicant.

Of course, by such an agglomerating blend, obtaining advantages in terms of reduction in agglomeration time, necessary amount of agglomerating agent, selectivity, yield and water content in the agglomerate, is possible as well, even for already agglomeratable coals.

Furthermore, due to the low concentration of the products used in the agglomerating solvent (not destined to be recovered), such route also shows favourable characteristics of cheapness.

The process for coal beneficiation, of the present invention, by selective agglomeration, is characterized in that an agglomerating blend is used, which is constituted by:

one or more main agglomerating agent(s), selected from the light hydrocarbons having a boiling temperature not higher than 70° C.;

one or more non-ionic additive(s) selected from oil-soluble ethoxylated compounds:

one or more heavy co-agglomerating agent(s) selected from oils deriving from the distillation of tar from coal pyrolysis (coal-tar), having a boiling temperature comprised within the range of from 200° to 400° C.

or the residual products from oil processing or blends thereof.

The main agglomerant(s) is(are) preferably constained in an amount comprised within the range of from 5 to 50% by weight relatively to coal, more preferably of from 5 to 20% by weight. The preferred light hydrocarbons are n-pentane, n-hexane and petroleum ethers.

The additive(s) is(are) preferably contained in an amount comprised within the range of from 0.02 to 1% by weight, relatively to coal, more preferably of from 0.05 to 0.3% by weight.

The oil-soluble ethoxylated compounds are selected from the ethoxylated alkylphenols, having an alkyl radical with a number of carbon atoms preferably comprised within the range of from 8 to 12, more preferably of from 8 to 10, carbon atoms, and with a number of ethyoxy groups preferably within the range of from 3 to 8, preferably of from 3 to 5, ethoxy groups, among which above all ethoxylated octyl-phenol and ethoxylated nonyl-phenol with 3 or 4 ethoxy groups are mentioned.

The heavy co-agglomerating agent(s) is(are) preferably contained in an amount comprised within the range of from 0.2 to 3% by weight, more preferably of from 0.2 to 2% by weight, relatively to coal. Such products, used in so small amounts, can be advantageously left on the beneficiated coal, without serious economic disadvantages.

Normally, the oils deriving from the distillation of coal-tar are obtained by successive fractionations by distillation.

For example, already from the first distillation treatment, two products, which can be used as co-agglomerating agents (a raw, first-boiling anthracene oil, having a boiling temperature comprised within the range of from 230° to 400° C.; and a second-boiling anthracene oil, having a boiling temperature comprised within the range of from 270° to 400° C.), and a lighter product, which cannot be used as such, are obtained. But, from said lighter product, after phenol removal and further re-distillation, other cuts are obtained, the heaviest of which (the gas-washing oil, the so-said "benzene-removal oil", having a boiling range of from 235° to 300° C., and the paste-like anthracene oil, having a boiling range of from 300° to 400° C.), can be used as co-agglomerating agents.

Such oils, deriving from coal-tar distillation, can be used either alone, or mixed with one another. A particular blend of these oils is, e.g., creosote oil, which is constituted by a blend on anthracene oils.

The products which are not liquid at room temperature (the "paste-like products") can be used as such, or they can be used in a fluid form, obtained by controlled crystallization and filtration of the paste-like product used as the starting material.

A typical composition of a paste-like anthracene oil is shown in Table 1.

TABLE 1

| Main Characteristics and Typical Composition of Thick Anthracene Oil | |
|---|---|
| Flowability temperature: | 70–80°C. |
| Distillation range: | 300–400° C. |
| Density: | 1.13–1.14 |

TABLE 1-continued

| Main Characteristics and Typical Composition of Thick Anthracene Oil | |
|---|---|
| Approximate composition: | |
| Acenaphthene and fluorene | 5% |
| Phenanthrene | 30% |
| Anthracene | 10% |
| Carbazole | 10% |
| Pyrenes | 5% |
| Products with heteroatoms (N and O) the balance to 100% being given by higher products homologous of the listed ones. | 2%, |

The "fluid" version contains approximately 40% less of anthracene and carbazole, whilst the higher homologous products, most of which are liquid, remain in the filtrate product.

The residues from petroleum processing can be those deriving from atmospheric distillation, vacuum distillation residues, or cracking treatments. Said residues can be used as such, or they can be previously "fluxed" with middle distillates (gas oil, kerosene, and so forth).

The "fluxed" residues are more commonly denominated as "fuel oils".

The steps into which the process of the present invention is subdivided are those known from the prior art, i.e., they are the following:

Coal grinding to a granulometry not larger than 4 mm, preferably not larger than 1 mm;

dispersion of ground coal in water, at a concentration comprised within the range of from 5 to 30% by weight relatively to the same dispersion;

addition to the so-formed dispersion of the agglomerating blend, either alone, or as a previously prepared aqueous emulsion;

high-intensity stirring of the dispersion for a time prefereably comprised within the range of from 1 to 5 minutes;

stabilization and growth of the products of coalescence by means of mild stirring for a time preferably comprised within the range of from 1 to 10 minutes;

separation of the agglomerate from the inorganic matter dispersed in the aqueous phase by sieving, and, optionally, washing of the agglomerate, or by skimming, or by decantation.

For the purpose of better illustrating the meaning of the present invention, some examples are reported in the following, which however must not be understood as being limitative of the same invention.

The coals mentioned in said examples were preliminarily characterized by measuring some microcalorimetric parameters (i.e., the ratio between the heat of dipping, Qi, in n-heptane and in water, which are well correlated with their degree of surface hydrophobic characteristics, and, hence, with their propensity to agglomeration (agglomerative characteristics).

In such way, as reported in following Table 2, the present Applicant was able to demonstrate how even those coals which show a much more unfavourable surface situation (as expressed by the $Qi_{n\text{-}heptane}/Qi_{water}$ ratio), such to not agglomerate even with liquids endowed with high bridging properties, such as kerosene (Example 5), can be easily agglomerated by means of the hereby claimed blend (Examples 1, 23).

TABLE 2

| Measured Parameters | COAL: Polish High-Volatility Bituminous coal | Russian High-Volatility Bituminous Coal | Italian (Sulcis) Subbituminous Coal |
|---|---|---|---|
| $Qi_{water}$, J/g | 7.9 | 28.5 | 73.5 |
| $Qi_{n\text{-}heptane}$, J/g | 4.9 | 4.9 | 3.1 |
| $Qi_{n\text{-}heptane}Qi_{water}$ | 0.62 | 0.17 | 0.04 |
| AGGLOMERATION | | | |
| With n-petane | Agglomerates (Example10) | Does not agglomerate | Does not agglomerate |
| n-petane + 0.3% by weight of ethoxylated phenol (referred to coal) | — | Does not agglomerate | Does not agglomerate |
| n-pentane + 0.05% by weight of ethoxylated phenol (referred to coal) + 1% by weight of fluid anthracene oil, referred to coal | Agglomerates (Example 11) | Agglomerates (Example 1) | Does not agglomerate |
| n-pentane + 0.3% by weight of ethoxylated phenol (referred to coal) + 2% by weight of fluid anthracene oil, referred to coal | — | — | Agglomerates (Example 15) |
| n-pentane + 1% by weight of fuel oil (referred to coal) | Agglomerates | Agglomerates (Example 16) | Does not agglomerate |
| n-pentane + 3% by weight of fuel oil (referred to coal) | — | Agglomerates (Example 17) | Does not agglomerate |
| n-pentane + 1% by weight of fuel oil (referred to coal) + 0.05% by weight of ethoxylated phenol (referred to coal) | — | Agglomerates (Example 18) | Does not agglomerate |
| n-pentane + 2% by weight of fuel oil (referred to coal) + 0.3% by weight of ethoxylated phenol (referred to coal) | — | — | Agglomerates (Example 22) |

EXAMPLE 1

A Russian bituminous coal containing 15% by weight of ashes is ground to a maximum granulometry of 750 μm. An amount of 40 g of such product is dispersed in 160 ml of water and is stirred for 5 minutes, in order to secure the maximum dispersion of the inorganic matter.

Under conditions of very intense stirring, an amount of the agglomerating blend equal to 15% by weight relatively to coal is added. Such agglomerating blend is constituted as follows: n-pentane, fluid anthracene oil (obtained from the paste-like anthracene oil as hereinabove described), ethoxylated nonyl-phenol with an average of 3 ethoxy groups, in the ratio of 14:1:0.05 by weight respectively. The agglomeration starts after an approximate time of 10 seconds, the intense stirring (1,800 rpm) is maintained for 2 minutes, then, after decreasing the stirring rate to 800 rpm, the stirring is continued for a further 3 minutes. The agglomerated coal is recovered by sieving.

The results are shown in Table 3.

COMPARATIVE EXAMPLES 2-5

The same Russian bituminous coal of Example 1, still ground to a highest granulometry of 750 μm, is treated under the same conditions as disclosed in Example 1, with the agglomerating agent being varied.

In Example 2, only n-pentane is used, in amounts of 15, 30 and 50%, relatively to coal, also resorting to long stirring times (up to 1 hour); in Example 3, an amount of 15% by weight, referred to coal, of an agglomerating blend consisting of fluid anthracene oil (50% by weight) and n-pentane (50% by weight) is used; in Example 4, only fluid anthracene oil in an amount of 10% by weight relatively to coal is used; and in Example 5, petroleum distillates (kerosene, gas oil) in amounts of 10, 30 and 50% by weight, referred to coal, and stirring times of up to 1 one hour are used.

The results are shown in Table 3.

TABLE 3

| Example | Heat Value Recovery | Ashes, % by weight | Total stir ring time |
|---|---|---|---|
| 1 | 98.0 | 3.1 | 5 minutes |
| 2 | does not agglomerate | | up to 60 minutes |
| 3 | 97.7 | 5.1 | 5 minutes |
| 4 | 97.6 | 6.5 | 5 minutes |
| 5 | does not agglomerate | | up to 60 minutes |

EXAMPLE 6

An amount of 40 g of the same coal as of Example 1 is ground to a granulometry smaller than 200 μm, and is processed according to the same process as disclosed in Example 1, with only the treatment times (7 minutes) and the composition of the agglomerating blend being varied, as follows:

n-pentane;
fluid anthracene oil (obtained from the paste-like oil);
3-E0 nonyl-phenol
in the weight ratio of 14:1:0.1 respectively.

The results can be summarized as follows:
Recovery of heat value: 96.8%;
Ashes: 3.1% by weight.

EXAMPLE 7

As compared to Example 6, only the composition of the agglomerating blend is varied, as follows:

n-pentane;
fluid anthracene oil (obtained from the paste-like oil);
3-E0 nonyl-phenol
in the ratio of 14:2:0.1% by weight respectively.

The results are summarized as follows:
Recovery of heat value: 99%
Ashes: 2.9% by weight.

EXAMPLE 8

Relatively to Example 1, only the composition of the agglomerating blend is varied, as follows:

n-pentane;
raw, first-boiling anthracene oil (of paste-like consistency);
3-E0 nonyl-phenol
in the weight ratio of 14:1:0.1 respectively.

The results are summarized as follows:
Recovery of heat value: 96.3%
Ashes: 3.4% by weight.

EXAMPLE 9

Relatively to Example 1, only the composition of the agglomerating blend is varied, as follows:

n-pentane;
gas-washing oil;
3-E0 nonyl-phenol
in the weight ratio of 14:1:0.1 respectively.

The results are the following:
Recovery of heat value: 98.8%
Ashes: 3.2% by weight.

EXAMPLE 10

The Polish bituminous coal is treated, which has an initial ash content of 10.5%, with the same modalities as provided for the Russian coal of Example 1, but with n-pentane being used as the only agglomerating agent, in an amount of 15% by weight, relatively to coal.

The results can be summarized as follows:
Recovery of heat value: 95.6%
Ashes: 4.0%
Total stirring time: 5 minutes

EXAMPLE 11

Relatively to Example 1, the Polish coal as of Example 10 is used, but with the agglomerating blend as of Example 1 being used.

The results can be summarized as follows:
Recovery of heat value: 98.5%
Ash content: 3.8% by weight
Total stirring time: 3 minutes.

EXAMPLES 12–15

Relatively to Example 1, an Italian coal from Sulcis basin is used, which is already conditioned by an exposure of 6 months to the atmospheric agents, having an ash content of approximately 22% by weight.

Furthermore:

In Example 12, as the agglomerating agent only n-pentane alone is used in an amount of 15% by weight relatively to coal, with a total stirring time of up to 1 hour being applied; in Example 13, as the agglomerating agent only kerosene alone in an amount of 15%, 30 and 50% by weight relatively to coal is used, with a total stirring time of up to 1 hour; in Example 14, 15% of n-pentane, referred to coal, and an ethoxylated nonyl-phenol (with an average content of 4 ethoxy groups), at the concentration of 0.3% by weight, relatively to coal, are used, with a total stirring time of up to 1 hour being applied.

In Example 15, the blend consisting of:

n-pentane;
fluid anthracene oil;
4-E0 nonyl-phenol
in the ratio of 14:2:0.3 is used, with a total stirring time of 7 minutes being applied.

The results are summarized in following Table 4:

TABLE 4

| Example | Heat Value Recovery | Ashes, % by weight | Stirring time |
|---|---|---|---|
| 12 | does not agglomerate | | up to 60 minutes |
| 13 | does not agglomerate | | up to 60 minutes |
| 14 | does not agglomerate | | up to 60 minutes |
| 15 | 80.3 | 9.8 | 6 minutes |

COMPARATIVE EXAMPLE 16

40 g of the same Russian coal as of Example 1 is treated, under usual agglomeration conditions, with an amount of 15% by weight, relatively to coal, of agglomerating blend. Such agglomerating blend is constituted by n-pentane and petroleum fuel oil in the ratio of 14:1 by weight.

Fuel oil is in its turn constituted by 85% by weight of vacuum residues and 15% by weight of "fluxing" agents.

The agglomeration begins after approximately one minute only and lasts a further 15 minutes (high shear); stirring is then continued for 3 additional minutes (low shear).

The results are the following:
Recovery of heat value: 94%
Ash content: 3.2% by weight

COMPARATIVE EXAMPLE 17

By using an amount of 15% by weight, relatively to coal, of an agglomerating blend composed by n-pentane, and the same fuel oil as used in Example 16, in the ratio of 12:3 respectively, on the same amount of Russian coal as of Example 1, the agglomeration times are reduced by a few minutes only: from 15 to 12 minutes.

The results are less satisfactory in selectivity:
Recovery of heat value: 95.2%
Ash content: 5.2% by weight

EXAMPLE 18

The same amount of Russian coal as of Example 1 is still treated, by the usual modalities, with an amount of 15%, relatively to coal, of agglomerating phase; such phase is constituted by n-pentane, fuel oil as of Example 16, and ethoxylated nonyl-phenol with 3 ethoxy groups, in 14:1:0.5 ratios.

The agglomerating times are sharply reduced: the agglomeration starts after approximately 10 seconds, the agglomeration time (high shear) is of two minutes, and the low shear conditions are maintained for a further 3 minutes (as usually).

The results, at all comparable to those obtained with anthracene oil instead of fuel oil, are the following:
Recovery of heat value: 94.7%
Ash content: 3.0% by weight

EXAMPLE 19

Relatively to Example 18, the fuel oil is a petroleum-deriving, not-fluxed residue from vacuum distillation, added in an amount of 1% by weight relatively to coal.

The following results are obtained:
Recovery of heat value: 96.0%
Ash content: 3.2% by weight

EXAMPLE 20

Relatively to Example 18, the fuel oil is a visbreacking residue, added in an amount of 0.5% by weight relatively to coal.

The following results are obtained:
Recovery of heat value: 94.1%
Ash content: 3.2% by weight

COMPARATIVE EXAMPLE 21

As compared to Example 12 (Italian coal from Sulcis basin) an amount of 15% by weight relatively to coal of an agglomerating blend is used, which is constituted by 50% by weight of the same fuel oil as of Example 16, and by 50% of n-pentane.

The agglomeration takes place, but requires very long times: it starts after approximately 15 minutes and can be considered as complete to the best after a further time of approximately 30 minutes under high shear, and still 15 minutes under low shear.

The following results are obtained:
Recovery of heat value: 78%
Ash content: 10.5% by weight

EXAMPLE 22

As compared to Example 12, an amount of 15% by weight relatively to coal of an agglomerating blend is used, which contains, besides n-pentane, the same fuel oil as of Example 16, and ethoxylated phenol in 13:2:0.3 ratios.

The following results are obtained:
Recovery of heat value: 82%
Ash content: 8.8% by weight

EXAMPLE 23

As compared to Example 18, an amount of 15% by weight relatively to coal of an agglomerating blend is used, wherein n-pentane is replaced by n-hexane.

The results obtained are at all similar:
Recovery of heat value: 93.3%
Ash content: 3.1% by weight

We claim:

1. Process for beneficiating coal by selective agglomeration characterized in that an agglomerating blend is used, which is constituted by:

one or more main agglomerating agent(s), selected from the light hydrocarbons having a boiling temperature not higher than 70° C.;

one or more non-ionic additive(s) selected from oil-soluble ethoxylated compounds:

one or more heavy co-agglomerating agent(s) selected from oils deriving from the distillation of tar from coal pyrolysis (coal-tar), having a boiling temperature comprised within the range of from 200° to 400° C. or the residual products from oil processing or blends thereof.

2. Process according to claim 1, wherein the main agglomerating agent(s) is(are) contained in an amount comprised within the range of from 5 to 50% by weight relatively to coal, the additive(s) is(are) contained in an amount comprised within the range of from 0.02 to 1% by weight relatively to coal, and the heavy co-agglomerating agents) is(are) contained in amounts comprised within the range of from 0.2 to 3% by weight relatively to coal.

3. Processing according to claim 2, wherein the main agglomerating agent(s) is(are) contained in an amount comprised within the range of from 5 to 20% by weight relatively to coal, the additive(s) is(are) contained in an amount comprised within the range of from 0.05 to 0.3% by weight relatively to coal, and the heavy co-agglomerating agent(s) is(are) contained in amounts comprised within the range of from 0.2 to 2% by weight relatively to coal.

4. Process according to claim 1, wherein the light hydrocarbon agglomerating agent(s) is(are) selected from n-pentane, n-hexane and petroleum ethers.

5. Process according to claim 1, wherein the oil-soluble ethoxylated compounds are ethoxylated alkyl-phenols.

6. Process according to claim 5, wherein the ethoxylated alkyl-phenols have their alkyl group with a number of carbon atoms comprised within the range of from 8 to 12 carbon atoms, and contain a number of ethoxy groups comprised within the range of from 3 to 8 ethoxy groups.

7. Process according to claim 6, wherein the ethoxylated alkyl-phenols have their alkyl group with a number of carbon atoms comprised within the range of from 8 to 10 carbon atoms, and contain a number of ethoxy groups comprised within the range of from 3 to 5 carbon atoms.

8. Process according to claim 7, wherein the ethoxylated alkyl-phenols are selected from ethoxylated octyl-phenol and ethoxylated nonyl-phenol with 3 or 4 ethoxy groups.

9. Process according to claim 1, wherein the co-agglomerating agent(s) is(are) selected from the anthracene oils and gas-washing oil, either alone or blended with each other.

10. Process according to claim 9, wherein the anthracene oil blends are creosote oils.

11. Process according to claim 1, wherein the residue from petroleum processing derives from residues from atmospheric distillation or from vacuum distillation, or from cracking treatments.

12. Process according to claim 11, wherein the residue from petroleum processing is fuel oil.

* * * * *